US005896710A

United States Patent [19]

Hoyle

[11] Patent Number: 5,896,710

[45] Date of Patent: Apr. 27, 1999

[54] ACOUSTIC PANEL SYSTEM

[76] Inventor: Charlie Hoyle, 29 Fulton St., Bloomfield, N.J. 07003

[21] Appl. No.: 08/620,889

[22] Filed: Jul. 9, 1996

[51] Int. Cl.[6] ..... E04B 1/82

[52] U.S. Cl. ..... 52/144; 52/36.1; 52/71; 52/145; 52/239; 160/135

[58] Field of Search ..... 52/144, 145, 36.1, 52/36.4, 271, 802.1, 794.1, 795.1, 791.1, 787.11, 784.15, 784.16, 239, 266, 587.1, 589.1, 590.1, 590.2, 284, 578, DIG. 13; 160/135, 351, 236; 312/111, 351, 351.1, 351.11

[56] References Cited

U.S. PATENT DOCUMENTS

| | | | |
|---|---|---|---|
| 2,062,851 | 12/1936 | Wildermuth | 52/271 |
| 2,975,853 | 3/1961 | Friend . | |
| 3,748,799 | 7/1973 | Tough et al. | 52/144 |
| 4,037,385 | 7/1977 | Wahlquist | 52/70 X |
| 4,094,380 | 6/1978 | Kubayashi et al. | 181/285 |
| 4,158,936 | 6/1979 | Fulton | 160/135 X |
| 4,630,416 | 12/1986 | Lapins et al. | 52/239 |
| 4,785,565 | 11/1988 | Kuffner | 160/135 X |
| 4,884,988 | 12/1989 | McMurray | 160/135 X |
| 4,964,250 | 10/1990 | Nelson | 52/145 X |
| 5,009,043 | 4/1991 | Kurrasch | 52/145 |
| 5,069,011 | 12/1991 | Jenne | 52/144 |
| 5,131,194 | 7/1992 | Anderson | 52/144 |
| 5,147,120 | 9/1992 | Ray | 312/111 |
| 5,394,658 | 3/1995 | Schreiner et al. | 52/36.1 |
| 5,423,151 | 6/1995 | Caro et al. | 52/145 |
| 5,424,497 | 6/1995 | Dias et al. | 52/145 X |
| 5,490,357 | 2/1996 | Lin | 52/239 X |
| 5,564,805 | 10/1996 | Dickinson | 312/351 X |

OTHER PUBLICATIONS

Wenger Corporation, "What is Modularity Plus?", Jul. 1976.

*Primary Examiner*—Christopher Kent
*Assistant Examiner*—Timothy B. Kang
*Attorney, Agent, or Firm*—Friscia & Nussbaum

[57] ABSTRACT

An acoustic panel system is provided for partially acoustically isolating a portion of a space in, for example, a recording studio. The acoustic panel system is modular in design and includes a plurality of different sized acoustic panels which can be assembled together in various configurations to form complete or partial acoustically isolated areas within a space. The acoustic panel system includes wall mount members, wall panels, floor panels, ceiling panels, transparent viewing panels and door panels. The wall mount members are basically partial members either permanently or removably interconnected with the walls of a space. The wall panels can be interconnected with the wall mount members. The wall panels may include casters for facilitating the movement thereof, and may also include feet for supporting the panels on uneven flooring. The wall panels further include recesses along the upper edges thereof for cooperating with the casters and/or clips interconnected with the casters, on lower edges of the panels to allow for such panels to be stacked. Additionally, such wall panels can be connected together along the sides thereof to form partial or complete enclosures as desired.

16 Claims, 6 Drawing Sheets

ACOUSTIC PANEL SYSTEM

BACKGROUND OF THE INVENTION

1. Field of the Invention

This invention generally relates to an acoustic panel system for partially or completely, acoustically, isolating desired areas in a recording studio, and more specifically to such an acoustic panel system of a modular design having a plurality of different sized interconnectable panels for forming a partial or complete acoustical enclosure of a desired configuration.

2. Related Art

Acoustic panels, sometimes referred to as "gobos" in the sound recording industry, have been widely known and used in the past to acoustically partition areas in recording studios, or on stage, or in theatrical use, as well as in other areas of use. Such panels have been created with sound absorbing features or sound reflecting features in order to separate or isolate sounds, or to reflect and enhance sounds. These panels are used, for example, in a recording studio, to partially acoustically isolate one or more persons, for example a vocalist, from other persons, for example, musicians. Some such panels have been carefully tailored to obtain specific desired acoustical effects, while others have been put together from readily available materials in a more haphazard manner.

In either case, these past efforts at acoustic panel systems typically include one or more panels having a substantially similar size and substantially similar acoustical characteristics. Such panels have been placed next to each, and in some cases even joined together. However, none of these previous efforts are directed to an acoustic panel system of a modular construction including a plurality of different sized members for forming a partial or complete enclosure of a desired configuration.

In a sound recording studio the acoustic panel system of the present invention can be used to partially, acoustically, isolate desired areas in the studio in order to obtain desired effects such as separating a singer from the instrumentalists during a sound recording. The system of the present invention is modular and contains a plurality of different sized members which can be stacked to form sound partitions of varying heights. Some of the members, or areas thereof, could be transparent to allow one to see therethrough. Additionally, such panels can be positioned side by side and attached together along sides by attachment means. Further, the side walls of the panels could be curved to allow members to be joined together at any desired angle.

Examples of such of previous efforts of acoustic panels include:

U.S. Pat. No. 2,975,853 to Friend, discloses a sound absorbent translucent building block that has mechanical strength and a pleasing appearance while having light-transmitting and acoustic-absorbing qualities. Also disclosed is a method of making such translucent, sound-absorbent blocks comprising the step of bonding or fusing together the pieces that make up the block, namely hollow tubular members disposed within a frame.

U.S. Pat. No. 3,748,799 to Tough, et al., discloses a sound absorbent panel or partition member comprising a rigid panel positioned within an enclosing, channel-shaped, one-piece edge member. A piece of double face tape secures the ends of the edge member about the rigid panel and also provides for the attachment of the partition member to a structure. Sound absorbency is achieved by means of applying a woven material to the panel.

U.S. Pat. No. 4,094,380 to Kobayshi, et al., discloses a multi layered sound-proofing structure comprising a plurality of layers including a layer of a light aggregate material, a layer of material having the quality of insulating high frequency sounds but permitting penetration of low frequency sounds, another layer of light aggregate material, and a fourth layer of high sound-insulating ability covering the other layers except for the sound incident face of the first layer.

U.S. Pat. No. 4,630,416 to Lapins, et al., discloses a movable, prefabricated wall panel having a rigid rectangular frame for use in partitioning office space or other space where high noise reduction and absorption is necessary. The panel includes a core structure preferably comprising at least one honeycomb layer bounded by skins with small openings therein for creating a sound chamber. The skins are covered by a porous fiberglass material for absorbing sound.

U.S. Pat. No. 5,009,043 to Kurrasch, discloses an acoustic panel for use as part of a freestanding modular office partition. The panel has an open frame, a septum centrally located therewithin and expanded fiberglass batts on each side thereof. Each side of the frame has a perforated hardboard facing sheet adhesively bonded to the frame. A layer of open-cell foam is carried by the facing sheets and a foil layer is applied over the foam layer. The panel may be finished with a fabric material.

U.S. Pat. No. 5,069,011 to Jenne, discloses a portable acoustical panel for stage or theatrical use to reflect and enhance the sound produced by an orchestra or band or by actors in a play. The panel includes weighted supporting base having a roller thereon disposed at a corner of the panel to facilitate movement of the panel. The panel can be oriented either upright or sideways. The panel includes a canopy hingedly affixed to the main panel which may be positioned at an angle to the main panel. The panel is constructed of a lightweight honeycomb core having a rigid sheet material adhesively bonded to opposing faces thereof.

U.S. Pat. No. 5,131,194 Anderson, discloses a sound barrier double-pane window having panes of different thicknesses or different densities or a combination thereof to dampen sounds. The window also includes a gasket about the periphery of the panes for providing a sound-deadening seal between interior and exterior environments.

U.S. Pat. No. 5,423,151 to Caro, et al., discloses a tackable tile for use as a wall panel for creating a modular office system. The tile includes a frame, a composite material positioned within the frame, and a noise reducing acoustic material applied over the composite material.

None of these previous efforts disclose all of the benefits and advantages of the present invention, nor do these previous patents teach or suggest all of the elements of the present invention.

OBJECTS AND SUMMARY OF THE INVENTION

It is a primary object of the present invention to provide an acoustic panel system for acoustically altering an existing space.

It is another object of the present invention to provide an acoustic panel system for partially acoustically isolating a portion of a space.

It is even another object of the present invention to provide an acoustic panel system for completely acoustically isolating a portion of a space.

It is still even another object of the present invention to provide a modular acoustic panel system for acoustically altering an existing space.

It is yet another object of the present invention to provide a modular acoustic panel system having a number of different sized acoustic panels for partially acoustically altering an existing space.

It is even yet another object of the present invention to provide a modular acoustic panel system including a plurality of acoustic panels that are attachable together to acoustically alter a space.

It is still even yet another object of the present invention to provide a modular acoustic panel system including a plurality of acoustic panels that are stackable to acoustically alter a space.

It is an additional object of the present invention to provide an acoustic panel system including wall mount components for interconnecting a panel with the wall for acoustically altering a space.

It is even an additional object of the present invention to provide an acoustic panel system having casters for easily moving about the panels for acoustically altering a space.

It is yet an additional object of the present invention to provide an acoustic panel system having mortised casters for easily moving about the panels for acoustically altering a space.

It is still even an additional object of the present invention to provide an acoustic panel system having recesses formed along an upper edge of the panels for receiving casters therein of panels stacked thereon for acoustically altering a space.

It is a further object of the present invention to provide an acoustic panel system having feet for supporting the panels for acoustically altering an existing space.

It is even a further object of the present invention to provide an acoustic panel system including leveling bolts associated with the feet for leveling the panels on uneven flooring to acoustically alter a space.

It is still even a further another object of the present invention to provide an acoustic panel system including a plurality of acoustic panels that are stackable for storage.

It is yet a further object of the present invention to provide a modular acoustic panel system including a ceiling panel for forming a upper surface to completely acoustically isolate a portion of a space.

It is still yet a further object of the present invention to provide a modular acoustic panel system having transparent panel to permit one to see therethrough.

It is another object of the present invention to provide a modular acoustic panel system having a door panel which can be opened and closed to completely acoustically isolate a portion of a space.

It is even another object of the present invention to provide a modular acoustic panel system having a floor panel for acoustically altering a space.

It is still even another object of the present invention to provide a modular acoustic panel system having a floor panel configured to interconnect with wall panels for acoustically altering a space.

These and other objects are accomplished by the modular acoustic panel system of the present invention which includes a plurality of different sized acoustic panels which can be assembled together in various configurations to form complete or partial acoustically isolated areas within a space. The acoustic panel system of the present invention comprises wall mount members, wall panels, floor panels, ceiling panels, transparent viewing panels and door panels.

The wall mount members comprise partial members either permanently or removably interconnected with the walls of a space. The wall panels include casters partially extending from lower edges thereof for facilitating movement of the wall panels, feet for supporting the wall panels, and adjustment means for leveling the wall panels on uneven flooring. The wall panels further include recesses along the upper edges thereof for coacting with the casters on lower edges of the panels to allow for such panels to be stacked.

The floor panels include means for receiving the casters of the wall panels therewithin. The ceiling panels are likewise configured with protrusions to cooperate with the recesses formed on upper edges of the wall panels to position and retain the ceiling panels on the wall panels. The transparent viewing panels can be interconnected with the wall panels and/or the ceiling panels and/or the floor panels to permit one to see through the transparent viewing panel such that one is not visually isolated by the acoustic partition formed by the acoustic panel system of the present invention. Additionally, a door panel can be interconnected with wall panels to open and close a partitioned space formed by the acoustic panel system of the present invention.

The components of the present invention can be used in any desired combination, including some or all of the components, to form an acoustical partition according to one's desires or requirements. The acoustic panel system of the present invention is of a modular design and accordingly, the components of the system can be easily interconnected. In a preferred embodiment of the invention, the panels can be stacked upon each other as hereinbefore described and as will hereinafter be described in more detail. Additionally, the panels can be joined together by any known attachment means as will hereinafter be described.

BRIEF DESCRIPTION OF THE FIGURES

Other important objects and features of the invention will be apparent from the following Detailed Description of the Invention taken in connection with the accompanying drawings in which.

DETAILED DESCRIPTION OF THE INVENTION

Figure 1:
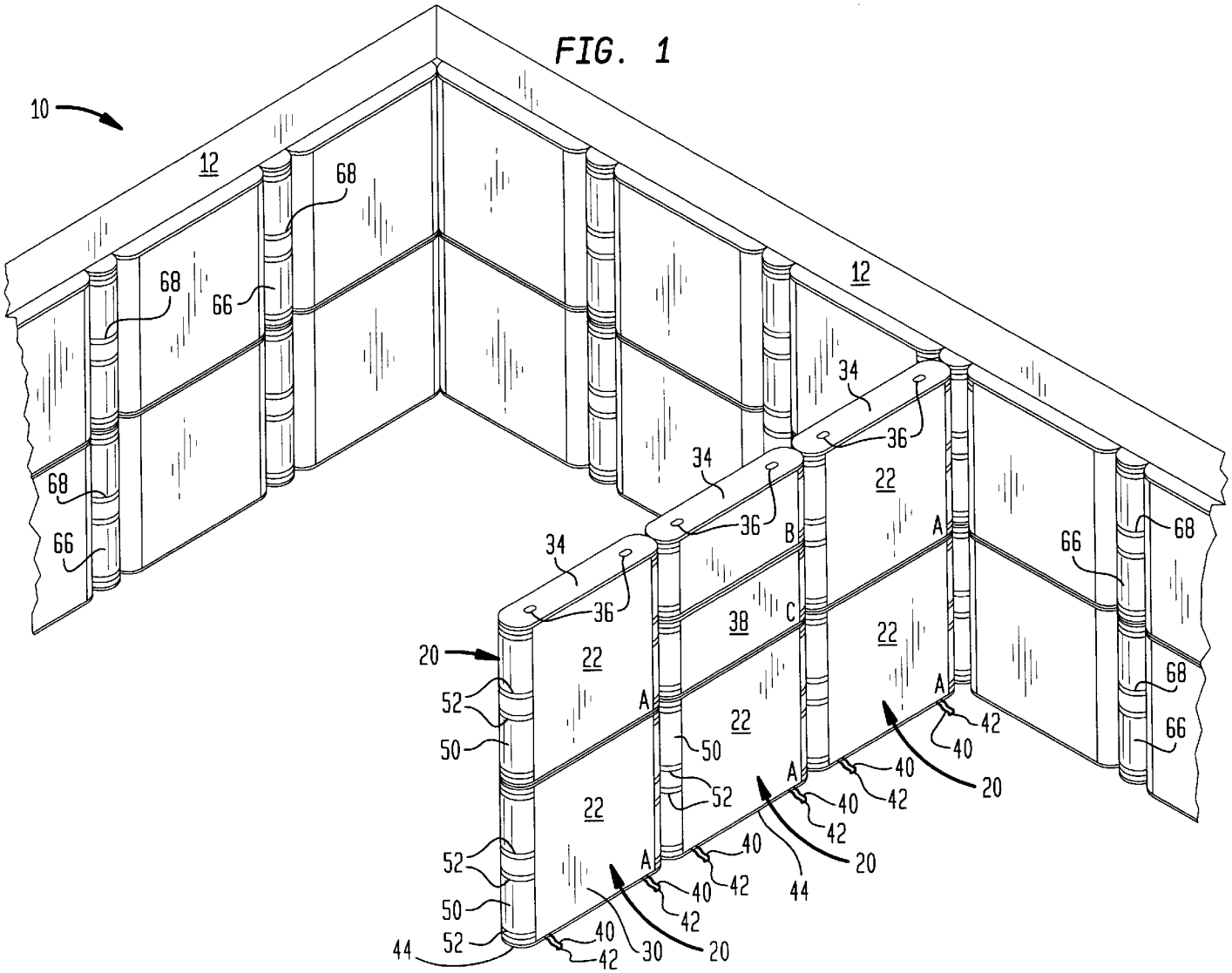
FIG. 1 shows a perspective view of the modular acoustic panel system of the present invention in a space.

Referring to FIG. 1, the acoustic panel system of the present invention is shown in perspective view. The acoustic panel system of the present invention comprises one or more acoustic panels, generally indicated at 20. As shown in FIG. 1, the acoustic panel system could positioned within a room such as a sound recording studio 10 having walls 12.

Alternatively, the acoustic panel system of the present invention could be used in any other space where it is desired to completely or partially acoustically isolate an area within a space, or alternatively to provide sound reflection within a space. The acoustic panel system of the present invention may be used in a recording studio, to partially acoustically isolate one or more persons, for example a vocalist, from other persons, for example, musicians.

As can be seen with reference to FIG. 1, as well as to the other FIGS., the acoustic panel system of the present invention is modular and contains a plurality of different sized panels which can be stacked and attached together to form sound partitions of varying heights and lengths. In keeping with the modular approach, it is desirable that the various panels can be quickly and easily joined together to form any desired size or shape partition. Accordingly, many features of the various panels are consistent and uniform to allow for such connectivity.

Still referring to FIG. 1, it can be seen that the acoustic panels 20 of the present invention comprise a front surface 22, a rear surface 24 (see FIG.2), an upper edge 34, having recesses 36 formed therein for purposes to be hereinafter described, and a lower edge 44. Interconnected with the lower edge 44 are feet 40 for supporting the panel in a standing position. Adjustable legs 42 interconnected with the feet 40 for permitting the panels to stand on uneven flooring. The side edges 50 of the panels 20 are preferably semi-cylindrical in shape and are flush in abutment with the front and rear surfaces 22 and 24 of the panels 20. As will hereinafter be described, the side edges 50 facilitate the attachment of the panels 20 together at angles. Further, an attachment means 52 is interconnected with the side edges 50.

By attaching various panels 20 of the present invention together, one can obtain a partition of virtually any desired size or shape. Again referring to FIG. 1, it can be seen that a partition can be formed with one or more basic square panels indicated as A. Additionally, various other sized panels 20, as desired, can be used and interconnected. For example, smaller, rectangular panel B can be interconnected with the A panels. Additionally, a transparent panel C can be interconnected with the other panels to permit one to see through the partition formed by the panels 20. Transparent panel C will be more fully described hereinafter. The transparent panel C has a transparent covering 38 thereon to permit a person to see therethrough. Of course, other sized panels can be fabricated and used as desired.

The acoustic partitions of the present invention can be formed with or without the use of wall mounts 66. If wall mounts 66 are not used, the semi-cylindrical side edges of the panels can abut against a wall 12. Further, attachment means may be employed to retain such panel against the wall 12. For example, an adhesive means could be applied to the side wall 50 of the panel 20 to coact with the wall 12 or even another panel to secure the panel to the wall or to another panel. Alternatively, if the wall 12 includes a fabric material, it may be possible to attach a panel 20 thereto by means of hook and pile type fasteners applied to the side wall 50. Alternatively, a unisex attachment means could be employed such as the one manufactured and sold by 3M Company called Dual Lock. When wall mounts 66 are used, a panel 20 can easily be attached thereto by means of the attachment means 52 associated with the side wall 50 of the panel and the corresponding attachment means 68 associated with the wall mount 66. Basically, in a preferred embodiment, the wall mount comprises a side edge 50 of a panel 20 connected directly to a wall 12. Such wall mounts 66 could be strategically located about a particular space to readily avail the space of acoustic partitioning by means of the acoustic panel system of the present invention.

Figure 2:
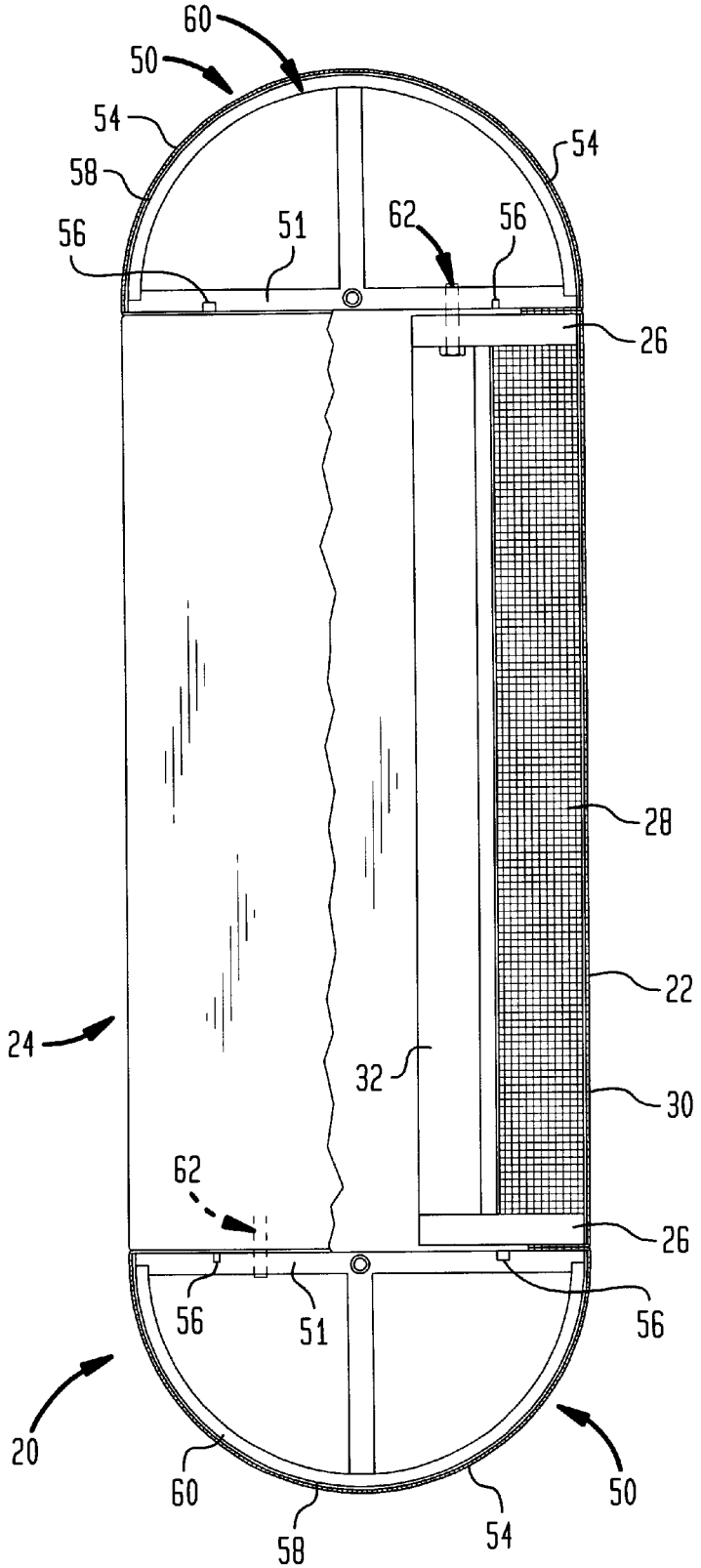
FIG. 2 is a top, partial cross sectional view of a panel shown in FIG. 1.

Referring now to FIG. 2, a partial cross sectional view of an acoustic panel 20 of the present invention is shown. The panel 20 includes front and rear surfaces 22 and 24 respectively, and side edges 50. The front and rear surfaces 22 and 24 are formed of any desired construction. As shown in FIG. 2, the construction of the front surface 22 includes a frame having members 26 forming a perimeter. The frame members 26 are interconnected with support members 32 to as necessary. Interconnected with the frame members 26 is an acoustic material 28 which may have any desired acoustic characteristics. Applied over the acoustic material 28 and the frame members 26 is a covering fabric 30. The covering fabric 30 may include any desired acoustic characteristics. Also, the covering fabric 30 may be attached to the frame members 26 by any means known in the art.

The construction of the side members 50 of the panels 20 may vary in accordance with what is known in the art. Importantly, it is desirable in accordance with the present invention to construct the side members 50 of a semi-cylindrical shape. Accordingly, a semi-cylindrical member 60 is interconnected with a base 51 which is interconnected with the frame members 26 by fastening means such as bolts 62 to attach the side member 50 to the front and rear surfaces 22 and 24 to form a panel 20. The semi-cylindrical member 60 may be interconnected with the base member 51 by means known in the art. Applied over the semi-cylindrical member 60 may be a cushioning material 58, and applied thereover may be a fabric 52. The fabric 54 may be attached about the semi-cylindrical member 60 and attached to the base 51 in accordance with what is known in the art, i.e. by fabric attachment means 56 which could comprise a notch in the base 51 into which is stuffed the fabric and an elastic material thereafter inserted into the notch to secure the fabric 54 to the base 51. Accordingly, what is thereby formed is a panel 20 have relatively planar front and rear surfaces 22 and 24 and semi-cylindrical side members 50.

Figure 3:
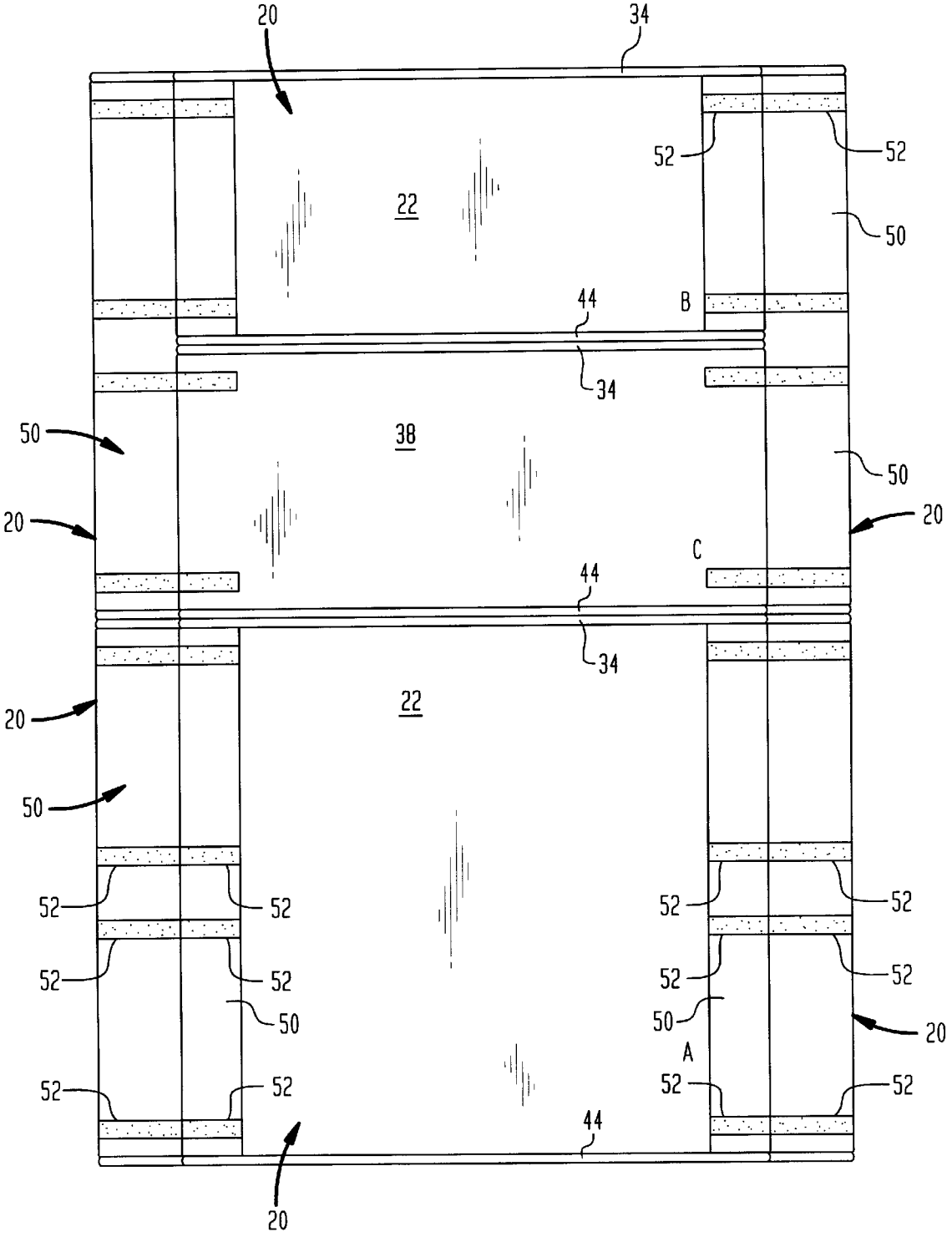
FIG. 3 is a front plan view of some panels comprising the acoustic panel system shown in FIG. 1.

Referring now to FIG. 3, it can be seen that the acoustic panels 20 of the present invention can be stacked one on the other to form a partition of any desired height. Additionally, it should be noted that such panels 20 may be the same or different sizes and still be stacked together in accordance with the modular aspects of the present invention. Accordingly, an A panel may have a C panel stacked thereon, and a B panel may be stacked thereon. Additionally, as shown in FIG. 3, panels may be attached to the edges of the stacked panels. Such panels attached along the edges of the panels may correspond in size to adjacent panels, or may be of different sizes. Because of the uniformity of the positioning of attachment means 52 along the side walls 50 of the panels 20, panels of different sizes can be attached together.

Importantly, any attachment means known in the art can be employed to attach adjacent panels 20 together. However, in a preferred embodiment, either unisex or hook and pile type fasteners are used. Accordingly, one side wall 50 could support hook type fasteners and the other could support pile type fasteners. Even more desirable is to have unisex or a combination of hook type and pile type fasteners together at each side wall 50. As such, when put into contact with an adjacent panel having similar attachment means, the hook type fasteners contact pile type fasteners on the adjoining panel, and vice-versa, to attach one panel 20 to an adjacent panel 20.

Figure 4:
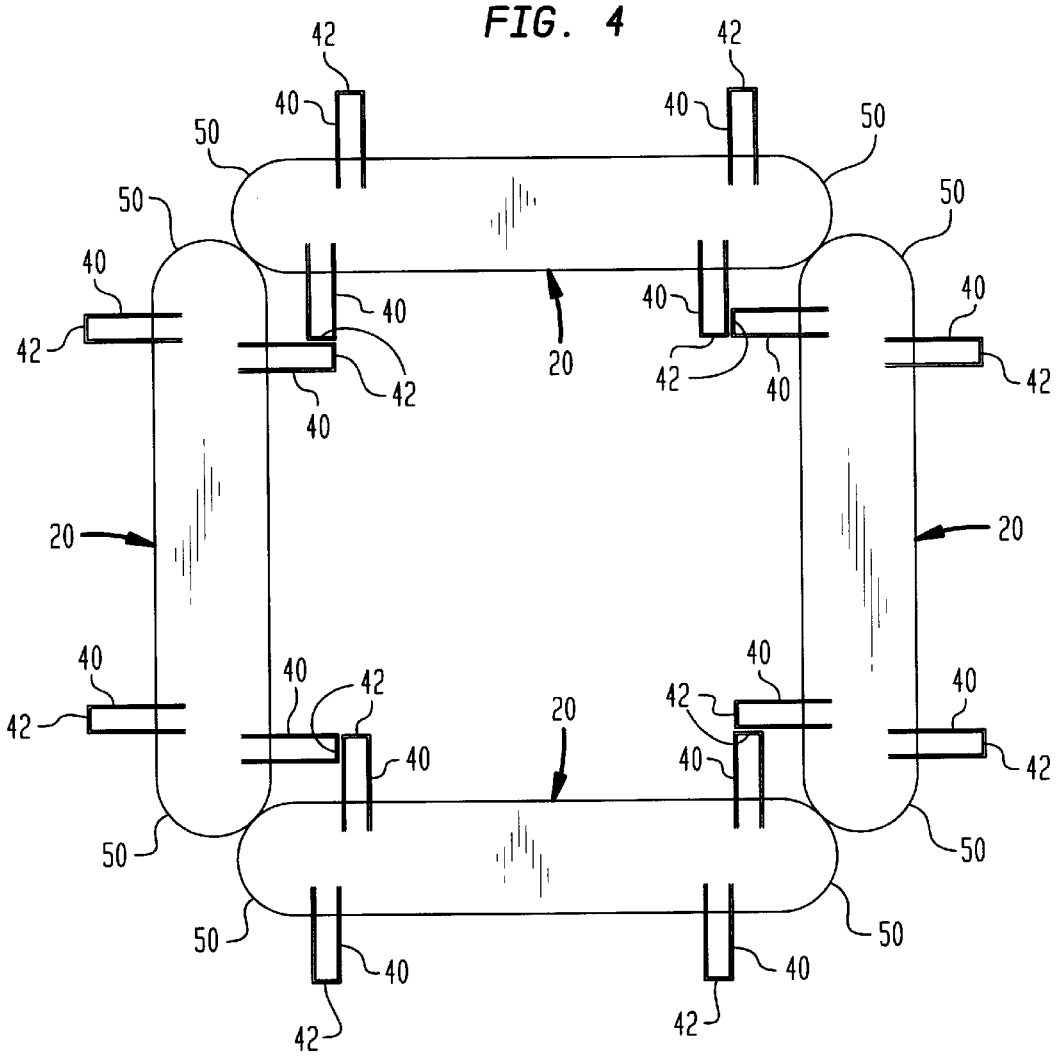
FIG. 4 is top plan view of the some panels of the present invention forming four-sided enclosure.

Referring now to FIG. 4, it can be seen that four, or more, panels 20 can be interconnected to form an enclosure. In such a case, the side members 50 of the panels are attached to adjacent panels at right angles, or any other desired angles. As additionally shown in FIG. 4, the feet 40 extend out from the panels 20 positioned along the floor to support the panels 20 in an upright position. Such feet could further include adjustable bolts 42 at the ends thereof which could be turned down to adjust the effective height of the feet to accommodate uneven flooring while still maintaining the panels in an upright position.

Figure 5:
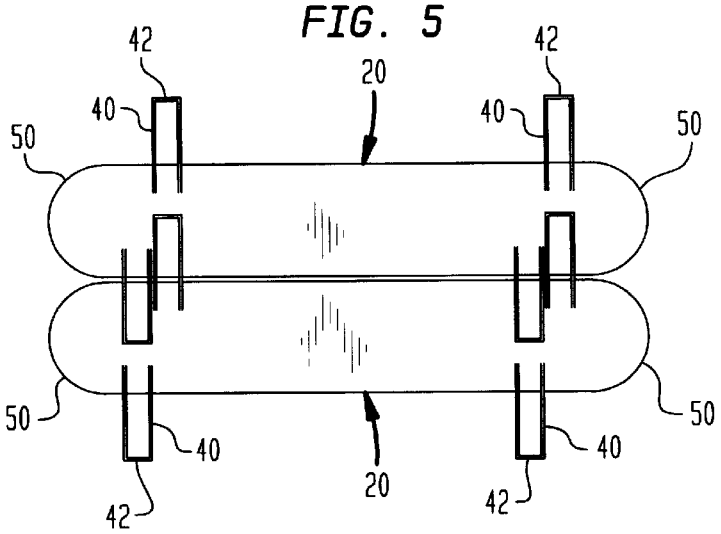
FIG. 5 is a top plan view of two panels of the present invention in a stacked arrangement.

As shown in FIG. 5, when not in use, it is desirable to arrange the panels 20 along each other to save space. Accordingly, the feet 40 are angled such that when aligned in side by side relation, the feet nest and permit one panel 20 to abut another panel 20.

Additionally, it should be pointed out that the feet 40 may be attached to any of the panels 20 in a panel system according to the present invention. Alternatively, the feet 40 could be supplied separately from the panels 20 and such feet could be attachable to the panels 20 in accordance with what is known in the art.

Figure 6:
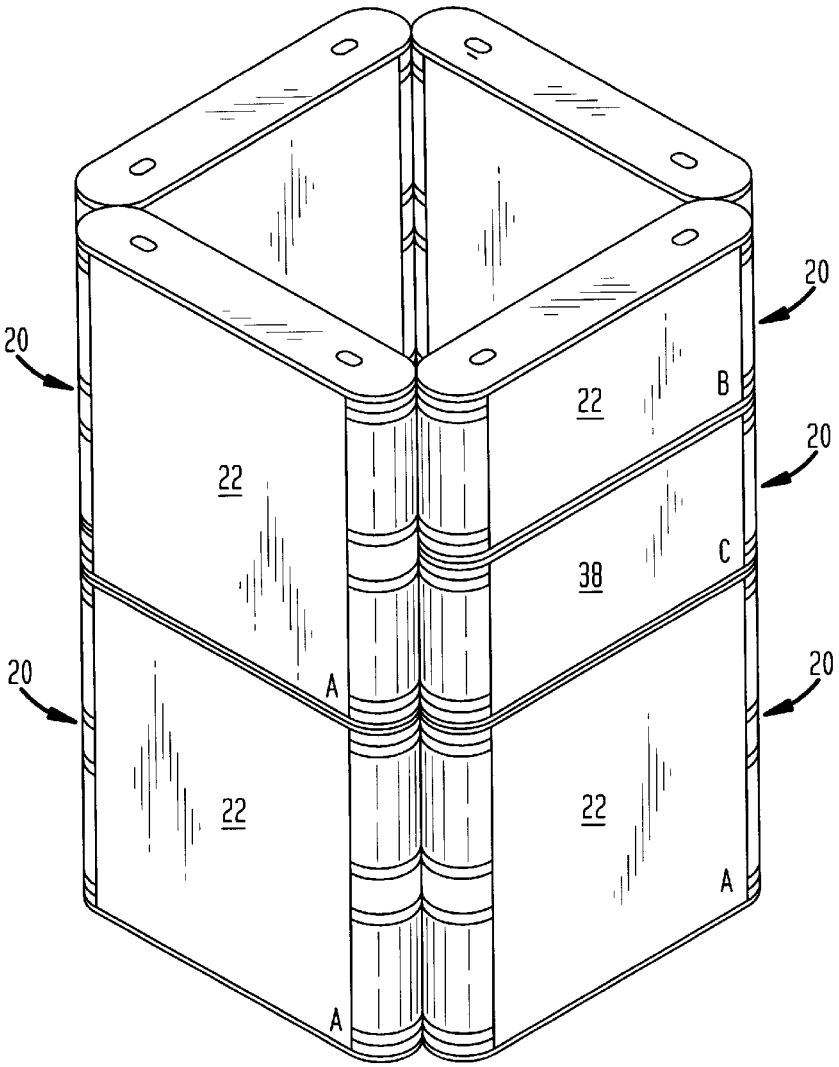
FIG. 6 is a perspective view of the four-sided enclosure shown in FIG. 4.

Referring now FIG. 6, a perspective view of a plurality of panels 20 arranged to form an enclosure is shown. Importantly, any number of panels 20 could be stacked in desired configuration to form an enclosure of any desired configuration. Additionally, it should be noted that one or more of such panels 20 could be utilized as a door, such panel or panels could have a reduced amount of attachment means to permit such door to be opened and closed. Also, it should be pointed out that separate panels could be used as a ceiling, if desired, and/or separate panels could be used as a floor if desired.

Figure 7:
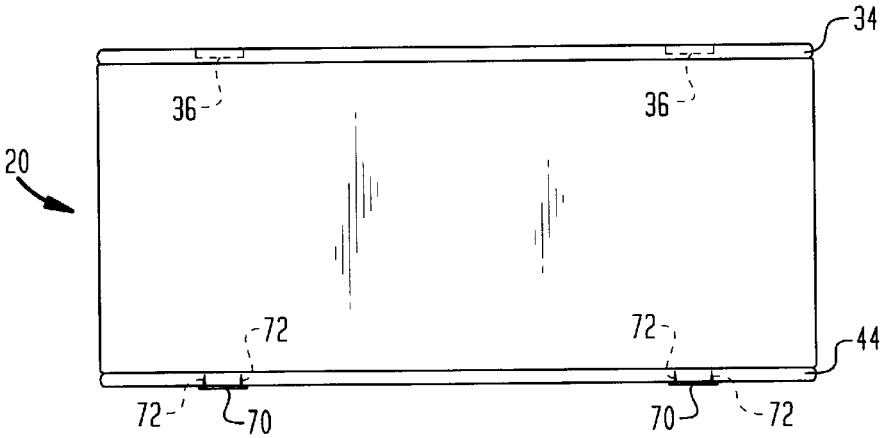
FIG. 7 is a cross sectional view of a panel of the present invention.

Referring now to FIG. 7, a cross sectional view of a panel 20 of the present invention is shown. The panel 20 includes an upper edge 34 and a lower edge 44. The lower edge 44 includes plates 70 attached to the lower edge 44 by means of screws 72 or other fastening means. The plates 70 are spaced away from the lower edge 44 in order that clips may be interconnected with such plates. As such, casters (not shown) can be attached to the plates by means of clips, e.g. clip on casters. Such casters are available under the tradename KWIK-KLIP from Magnus Mobility Systems, Inc., in California. Alternatively, casters can be interconnected with the lower edge 44 of the panels 20 in any other manner known in the art, including being permanently or removably attached, and/or being recessed therein. Removable casters are preferred because this allows the panels to either be positioned as lower panels or as upper panels. Importantly, the upper edges 34 of the panels include recesses 36 for receiving the plates 70 or the casters therein to facilitate the stackability of such panels 20.

Figure 8:
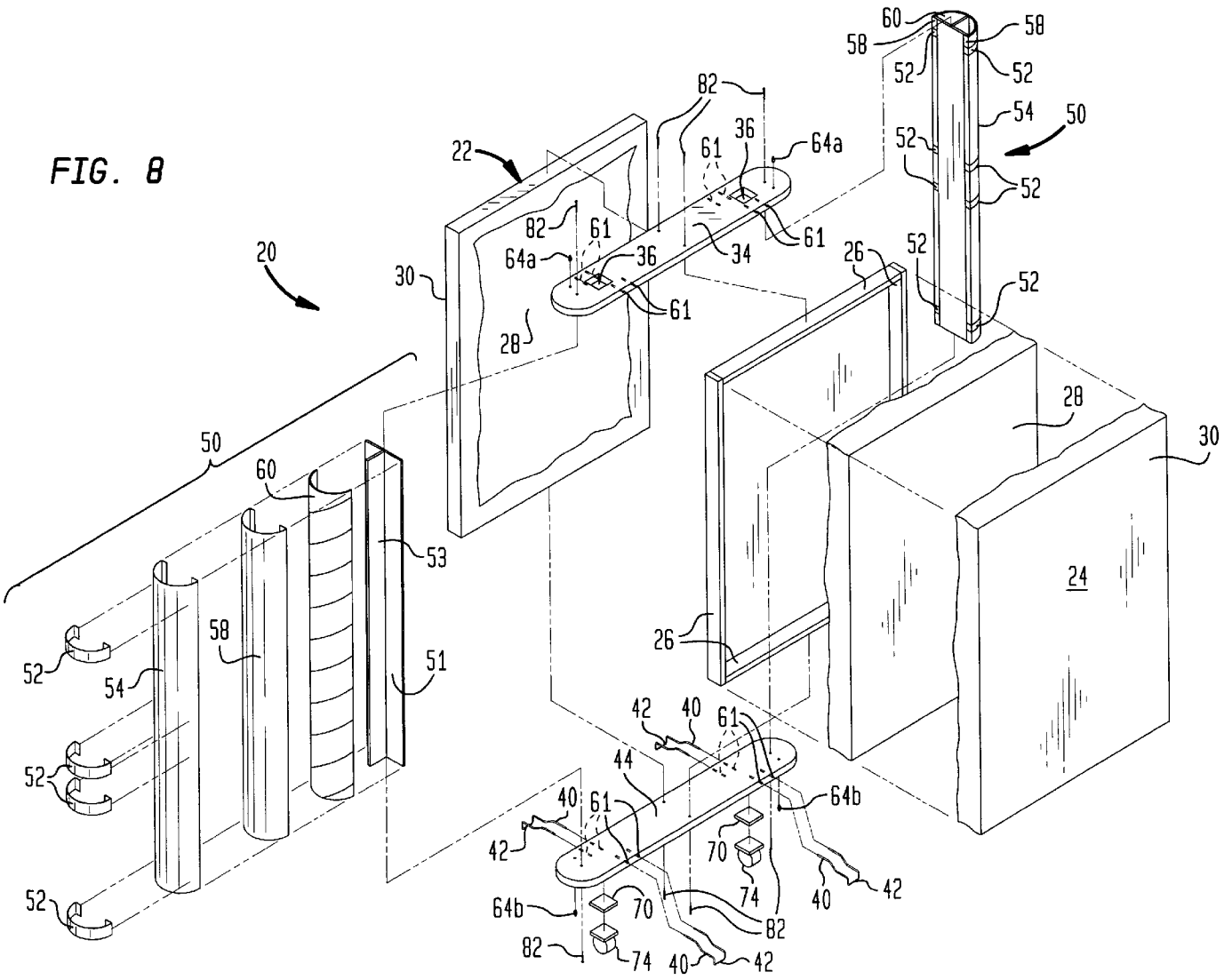
FIG. 8 is an exploded perspective view of a panel of the present invention.

Referring now to FIG. 8, an exploded perspective view of a panel 20 of the present invention can be seen. The panel 20 includes upper edge 34, lower edge 44, side edges 50, and front and rear surfaces 22 and 24. The front and rear surfaces 22 and 24 comprise frame members 26, acoustical material 28 positioned and retained within the frame members 26, and covering fabric 30 positioned about and attached to the frame members 26.

The side edges 50 generally comprise a plurality of interconnected components including a base 51 comprised of any suitable material for supporting the side edges 50. The base 51 may include a fin 53 for providing additional support to the side edges 50. A semicylindrical base 60 is interconnected with the base 51. Mounted to the semicylindrical base is a cushioning material 58, and mounted thereover is fabric 54. Of course, not every layer is required in the construction of the side edges 50, and other elements may be included. Importantly, the finished side edge 50 is semicylindrical to permit the attachment together of adjacent panels either in line or at an angle. Positioned over the fabric 54 or other exterior surface of the side edge 50 is fastening means for permitting attachment of one panel to an adjacent panel. As shown in FIG. 8, the attachment means comprises bands 52 positioned about the side edge 50 for coacting with similarly positioned bands located on other panels 50 to interconnect such panels together.

The upper edges 34 of the panels 50 are interconnected with the front and rear surfaces 22 and 24 by means of screws 82 or other suitable fastening means. Nipple means **64*a* may extend from the upper surface of upper edge 34 to coact with a panel placed on top of the upper edge 34 to locate such panel with respect to the upper edge 34 of the lower panel. Additionally, receptacle means, not shown, may be provided on the upper edge for receiving the nipple means from the lower edge of a panel stacked thereon. The upper edge 34 further includes recesses 36** for receiving plates or casters from the lower edge of a panel stacked thereon.

As additionally shown in FIG. 8, the lower edge 44 of the panel 20 may have plates 70 attached thereto for interconnecting with casters 74. Nipple means **64*b* can be interconnected with the lower surface 44 for locating the lower surface on the upper surface of another panel 20. Screws 82 or other fastening means extend through the lower surface to interconnect the lower edge 44** to the remainder of the panel.

Feet 40, as shown in FIG. 8, comprise prongs for being received in apertures 61 formed in the sides of lower edge 44. The prongs are attached together at a far end to form feet 42, which, as hereinbefore described, may be adjustable. Accordingly, the feet 40 may be connected with or disengaged with a lower edge 44 of a panel 20. Accordingly, if a panel is used as a lower panel, the feet 40 would be attached thereto. If however, the panel was to be stacked on another panel, the feet would be removed. Additionally, it should be pointed out that a fastening means, not shown, comprising a set of lower prongs interconnected with a set of upper prongs such the respective sets of prongs can be engaged with upper and lower panels by means of inserting such prongs into corresponding apertures in upper and lower edges 34 and 44, to thereby attach an upper and lower panel together.

The components of the present invention can be used in any desired combination, including some or all of the components, to form an acoustical partition according to one's desires or requirements.

Having thus described the invention in detail, it is to be understood that the foregoing description is not intended to limit the spirit and scope thereof. What is desired to be protected by Letters Patent is set forth in the appended claims.

What is claimed is:

1. An acoustic panel for acoustically altering a space comprising:

forward and rearward surfaces;

upper and lower edges, the upper and lower edges being generally planar;

the lower edge including a pair of partially recessed casters extending therefrom;

the upper edges including a pair of recesses aligned for receiving the casters from panels stacked thereon to position and retain an upper panel in position on a lower panel to form an acoustic wall having planar faces;

semi-cylindrical side edges, the diameter of the semi-cylindrical side edges corresponding to the distance between the forward and rearward surfaces to form a planar interface between the forward and rearward surfaces and the side edges; and attachment means on the side edges for attaching the panel to an adjacent panel.

2. The panel of claim 1 wherein the forward and rearward surfaces are generally planar and parallel to each other.

3. The panel of claim 2 wherein the forward and rearward surfaces include fabric applied thereover.

4. The panel of claim 3 wherein the fabric includes a desired acoustical characteristic.

5. The panel of claim 1 further comprising feet interconnected with the lower edge for supporting the panel in an upright position.

6. The panel of claim 5 further including adjustable legs extending downwardly from the feet for leveling the panel.

7. The panel of claim 1 wherein the semi-cylindrical side edges include attachment means interconnected therewith for interconnecting the panel about the circumference of the semi-cylindrical side edges with another similarly constructed panel at any desired angle with respect thereto.

8. The panel of claim 7, wherein the attachment means comprises unisex type fastening means positioned at locations along the side edges.

9. An acoustic panel system for acoustically altering a space comprising;

a first acoustic panel comprising:

forward and rearward planar surfaces;

upper and lower generally planar edges, the lower edges having protrusions and the upper edges having recesses, the protrusions and recesses positioned interiorly of the forward and rearward planar surfaces for coacting together to position and retain one panel on top of another panel to form an acoustic wall having planar faces and to constrain panels from side to side or forward to rearward movement with respect to each other;

semi-cylindrical side edges having attachment means extending along the side edges for attaching adjacent panels together; the side edges aligned with the forward attachment means having a semi-cylindrical face and a planar back capable of being mounted on a wall, wherein the first acoustic panel is adapted to be mounted on said attachment means; and rearward surfaces of the first panel to form a planar interface between the forward and rearward surfaces and the side edges;

second acoustic panel interconnectable with the first acoustic panel.

10. The system of claim 9 further comprising additional acoustic panels.

11. The system of claim 10 wherein the panels comprising the system are of varying size.

12. The system of claim 11 wherein the panels are positionable in stacked relationship.

13. The system of claim 11 wherein one or more of the panels comprising the system are transparent.

14. The system of claim 11 further comprising a ceiling panel for placement over one or more panels to form a ceiling.

15. The system of claim 14 further comprising a floor panel for placement under one or more panels to form a floor.

16. The system of claim 11 further comprising a door panel for interconnecting with one or more panels to form a door into a complete or partial enclosure by the panel system.

* * * * *